US011944193B1

(12) United States Patent
Swears

(10) Patent No.: US 11,944,193 B1
(45) Date of Patent: Apr. 2, 2024

(54) MULTI-WHEEL ROTATIONAL SHELVING ASSEMBLY

(71) Applicant: Eran Swears, Saratoga Springs, NY (US)

(72) Inventor: Eran Swears, Saratoga Springs, NY (US)

( * ) Notice: Subject to any disclaimer, the term of this patent is extended or adjusted under 35 U.S.C. 154(b) by 0 days.

(21) Appl. No.: 18/125,458

(22) Filed: Mar. 23, 2023

Related U.S. Application Data

(60) Provisional application No. 63/425,479, filed on Nov. 15, 2022.

(51) Int. Cl.
*A47B 49/00* (2006.01)

(52) U.S. Cl.
CPC ..... *A47B 49/002* (2013.01); *A47B 49/008* (2013.01)

(58) Field of Classification Search
CPC ..... A47B 49/00; A47B 49/002; A47B 49/004; A47B 49/008; A47F 3/06; A47F 3/10; A47F 3/11; A47F 5/02; A47F 5/025; A47F 5/03
See application file for complete search history.

(56) References Cited

U.S. PATENT DOCUMENTS 235,030 A * 11/1880 Sidle ..... A47B 49/00 108/103
828,926 A * 8/1906 Clare ..... A47B 49/002 211/164
1,854,559 A * 4/1932 Orr ..... A47F 5/03 40/493
5,040,689 A * 8/1991 Hull ..... A47B 49/008 211/121
5,109,989 A * 5/1992 Kremmin ..... A47F 5/025 211/163
5,339,968 A * 8/1994 Voelz ..... A47F 5/0081 211/121
5,809,874 A * 9/1998 Kim ..... A47B 49/002 211/164

(Continued)

FOREIGN PATENT DOCUMENTS

DE 3302018 A1 * 8/1984
DE 19512210 C1 * 5/1996 ..... A47B 49/002

(Continued)

*Primary Examiner* — Stanton L Krycinski
(74) *Attorney, Agent, or Firm* — Dale J. Ream

(57) ABSTRACT

The multi-wheel shelving assembly is a gearing system with a central drive gear, multiple planetary-gears, and a third layer of orbiting gears that each have a horizontal shelf attached and which remains level even as respective gears revolve. The shelf-orbiting gears and the planetary gears are radially arranged along concentric circumferential paths and connected to the central drive gear through complementary rotational movements and complementary gear teeth. The multi-wheel shelving assembly includes a framework having a faceplate coupled to the drive gear, an outer peripheral frame member pivotally coupled to the outer layer of orbiting gears and spokes connecting the peripheral outer frame member and faceplate and to which the plurality of planetary gears is pitifully attached. The peripheral outer frame member and, therefore, the plurality of orbiting gears are rotatably coupled to a hub whereas the drive gear is fixed in space.

17 Claims, 9 Drawing Sheets

(56) References Cited

U.S. PATENT DOCUMENTS

| | | | | |
|---|---|---|---|---|
| 8,616,381 | B1 * | 12/2013 | Forster | B41F 13/0016 211/121 |
| 9,326,599 | B1 * | 5/2016 | Sowers | A47B 49/008 |
| 2015/0122757 | A1 * | 5/2015 | Owens | A47B 49/002 211/126.3 |

FOREIGN PATENT DOCUMENTS

| | | | | |
|---|---|---|---|---|
| DE | 102008007126 | A1 * | 8/2009 | A47B 49/002 |
| KR | 20100032480 | A * | 3/2010 | |
| KR | 20120038149 | A * | 4/2012 | |
| WO | WO-2010086657 | A1 * | 8/2010 | A47F 5/03 |

* cited by examiner

MULTI-WHEEL ROTATIONAL SHELVING ASSEMBLY

REFERENCE TO RELATED APPLICATIONS

This application claims the benefit of provisional patent application number 63/425,479 filed Nov. 15, 2022 and titled GEAR-DRIVEN SHELVING WHEEL, which is incorporated herein in its entirety.

BACKGROUND OF THE INVENTION

This invention relates generally to shelving systems and, more particularly, to a shelving wheel that enables easy access to multiple shelf heights from a single standing or sitting position by spinning a system of gears.

A shelf is a flat horizontal surface used for display and storage of, for example, books, picture frames, kitchen items, vases, and the like. Shelving is most often constructed as multiple fixed layers of horizontal support services, i.e., multiple levels of planar boards or platforms mounted to a framework as multiple parallel support services. In many cases, the lower shelves may be accessible to a person in a sitting or standing position whereas the higher shelves may require a user to climb up a stepstool, stepladder, or traditional ladder in order to reach articles stored on the higher shelves. Obviously, retrieving items from upper shelves may be inconvenient and even dangerous. To be sure, traditional shelving is fixedly mounted and arranged at multiple parallel horizontal positions that are difficult to access without auxiliary equipment.

Therefore, it would be desirable to have a multi-wheel shelving assembly that is conveniently rotatable to bring a particular shelf to a level that is accessible to a seated or standing user without the need for a height augmenting device such as a stepladder. Further, it would be desirable to have a multi-wheel shelving assembly that utilizes a multi-wheel gear train to which a plurality of shelves is directly attached and which are configured such that the plurality of shelves remain perfectly level, i.e., parallel to a floor surface, even as they are rotated circularly to a desired access level.

SUMMARY OF THE INVENTION

The multi-wheel shelving assembly according to the present invention is a gearing system with a central drive gear, multiple planetary-gears, and a third layer of orbiting gears that each have a horizontal shelf attached. The shelf-orbiting gears and the planetary gears are radially arranged along concentric circumferential paths and connected to the central drive gear through complementary rotational movements and complementary gear teeth. The multi-wheel shelving assembly includes a framework having a faceplate coupled to the drive gear, an outer peripheral frame member pivotally coupled to the outer layer of orbiting gears and having spokes connecting the peripheral outer frame member and faceplate and to which the plurality of planetary gears is pivotally attached. The peripheral outer frame member and, therefore, the plurality of orbiting gears are rotatably coupled to a hub whereas the drive gear is fixed in space. Of critical importance, a shelf is coupled to a front side edge of each orbiting gear and to the drive gear and is configured to remain level or parallel to a floor surface at all times as the orbiting gears orbit the drive gear.

Therefore, a general object of this invention is to provide a multi-wheel shelving assembly, in which a plurality of shelves is rotationally movable to a desired access height using a multi-wheel gear train.

Another object of this invention is to provide a multi-wheel shelving assembly, as aforesaid, in which the multi-wheel gear train is configured such that operation thereof maintains each shelf in a level orientation, i.e., parallel to a ground or floor surface.

Still another object of this invention is to provide a multi-wheel shelving assembly, as aforesaid, in which the plurality of shelves is interconnected such that they move in unison when the plurality of gears is rotated by actuation of a circular frame member.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
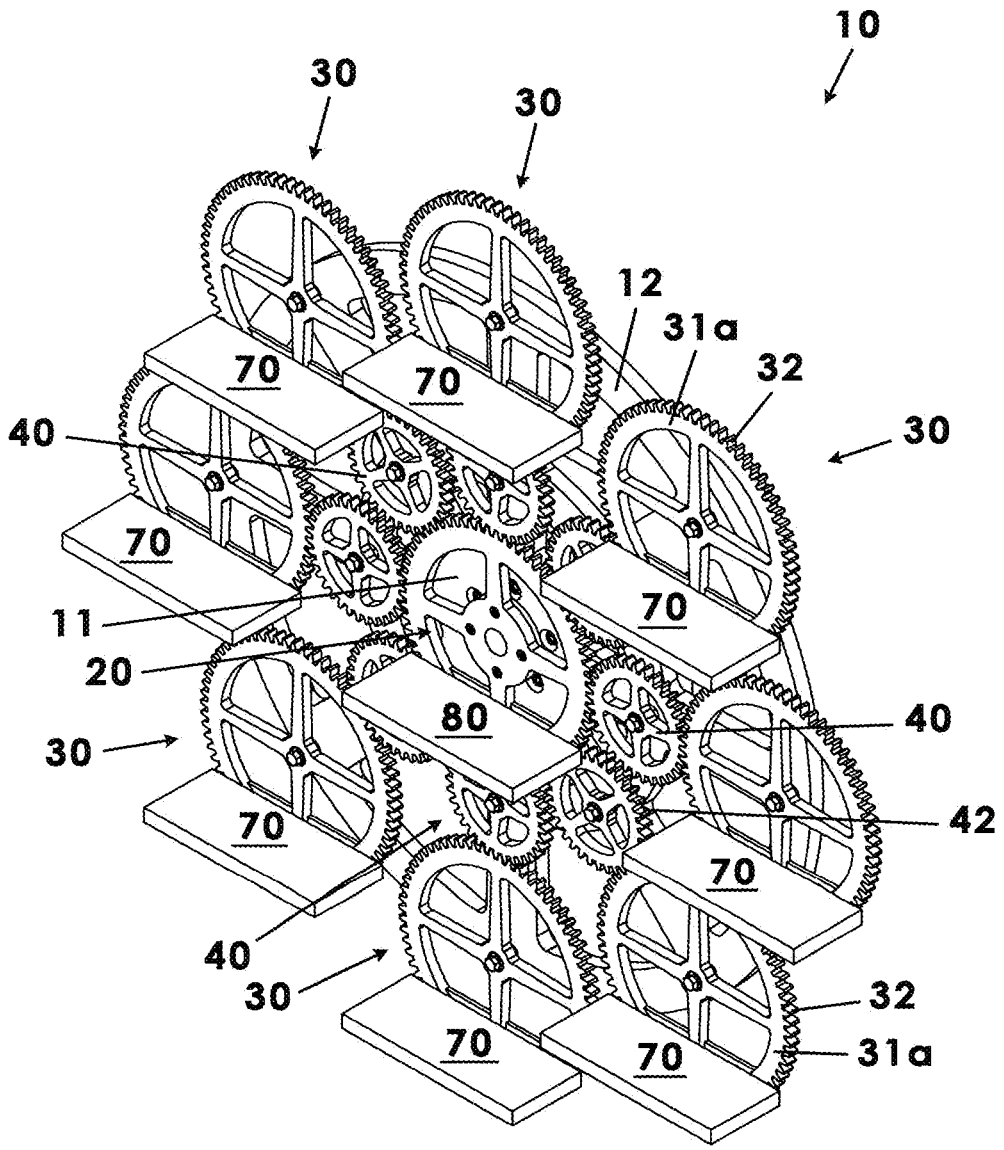
FIG. 1 is a perspective view of the multi-wheel rotational shelving assembly according to a preferred embodiment of the present invention.

A multi-wheel rotational shelving assembly according to a preferred embodiment of the present invention will now be described with reference to FIGS. 1 to 9*b* of the accompanying drawings. The multi-wheel rotational assembly 10 includes a drive wheel 20, an orbiting wheel assembly, a planetary wheel assembly positioned intermediate the drive wheel and orbiting wheel assemblies, respectively, and a plurality of shelves 70 coupled to the frontside edges of respective orbiting wheels, respectively.

The multi-wheel rotational shelving assembly 10 has a framework to which most or all of the components to be described in this application are directly or indirectly attached and which provides the unique functionality of the invention. More particularly, the framework includes an interface plate 11, a peripheral frame member 12, and a plurality of spokes 13 extending between the interface plate 11 and peripheral frame member 12. For context and clarification, the interface plate 11 may have a generally circular and planar configuration similar in appearance to a gear but with no teeth. The interface plate 11 will be described in greater detail later. In addition, the peripheral frame member 12 may have a circular or ring-shaped configuration, the peripheral frame member 12 defining a diameter that is larger than a diameter of the interface plate 11. Preferably, however, the interface plate 11 and peripheral frame member 12 are situated concentrically to one another and with the peripheral frame member 12 being radially displaced from the interface plate 11. In other words, each discrete point on the peripheral frame member 12 is equally displaced from a peripheral edge of the interface plate 11.

Explained geometrically for greater clarity, the peripheral frame member 12 defines an outer circumference of an imaginary circle and the interface plate 11, being displaced inwardly from the peripheral frame member 12, may be situated radially about a center point of the circle. Further, the hypothetical geometric circle defined by the peripheral frame member 12 defines an intermediate circumference situated between the outer circumference defined by the peripheral frame member and the center point, the intermediate circumference defining an imaginary circle that is concentric to that of the outer circumference and the center point. As will be discussed further in greater detail, the center point, intermediate circumference, and outer circumference will describe the configuration and orientation of the drive wheel 20, the orbiting wheel assembly 30, and the planetary wheel assembly 40.

Figure 5A:
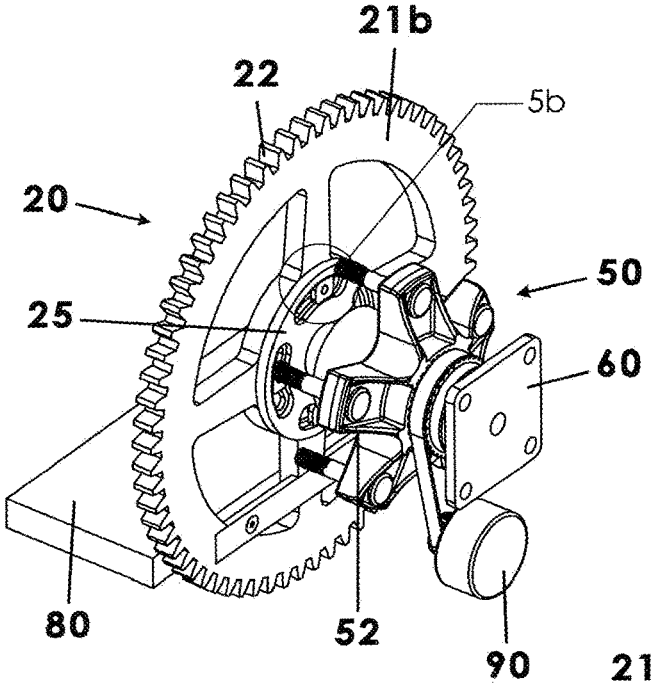
FIG. 5*a* is a rear perspective view of the drive wheel as in FIG. 4*b*, illustrated in isolation.

Preferably, the multi-wheel rotational shelving assembly 10 will be fixedly mounted to a wall structure, such as a residence, office, entertainment or commercial facility. Accordingly, the multi-wheel rotational shelving assembly 10 may include a mounting plate 60 that is configured for stable and unmovable attachment to a wall structure such as with bolts or similar fasteners (FIG. 5*a*). Also of critical importance, the mounting plate 60 may include a shaft 62 having an elongate and tubular configuration, the shaft 62 having a fixed construction that does not rotate and that extends axially through a central bore 51 defined by the hub 50, interface plate 11, and drive wheel 20 (FIG. 5*a*). It will be understood that the shaft 62 provides a fixed structure to which the drive wheel 20 is fixedly attached and is prevented from rotation whereas the hub 50 is rotatably mounted to the shaft 62 via bearings 54 so as to be rotatable. The specific structure of the hub 50 will be described immediately below.

The multi-wheel rotational shelving assembly 10 includes a hub 50. The hub 50 is specifically configured to enable other components to rotate, i.e., to enable the shelves to be rotated to accessible positions as may be determined by a user. The hub 50 defines a central bore 51 through which the shaft 62 extends, the hub 50 being mounted to the shaft 62 with bearings 54 such that the hub 50 is rotatable about a longitudinal axis defined by the shaft 62. (A bearing ring and bearing compression sleeve are shown in FIG. 6 and both labeled 54).

Figure 6:
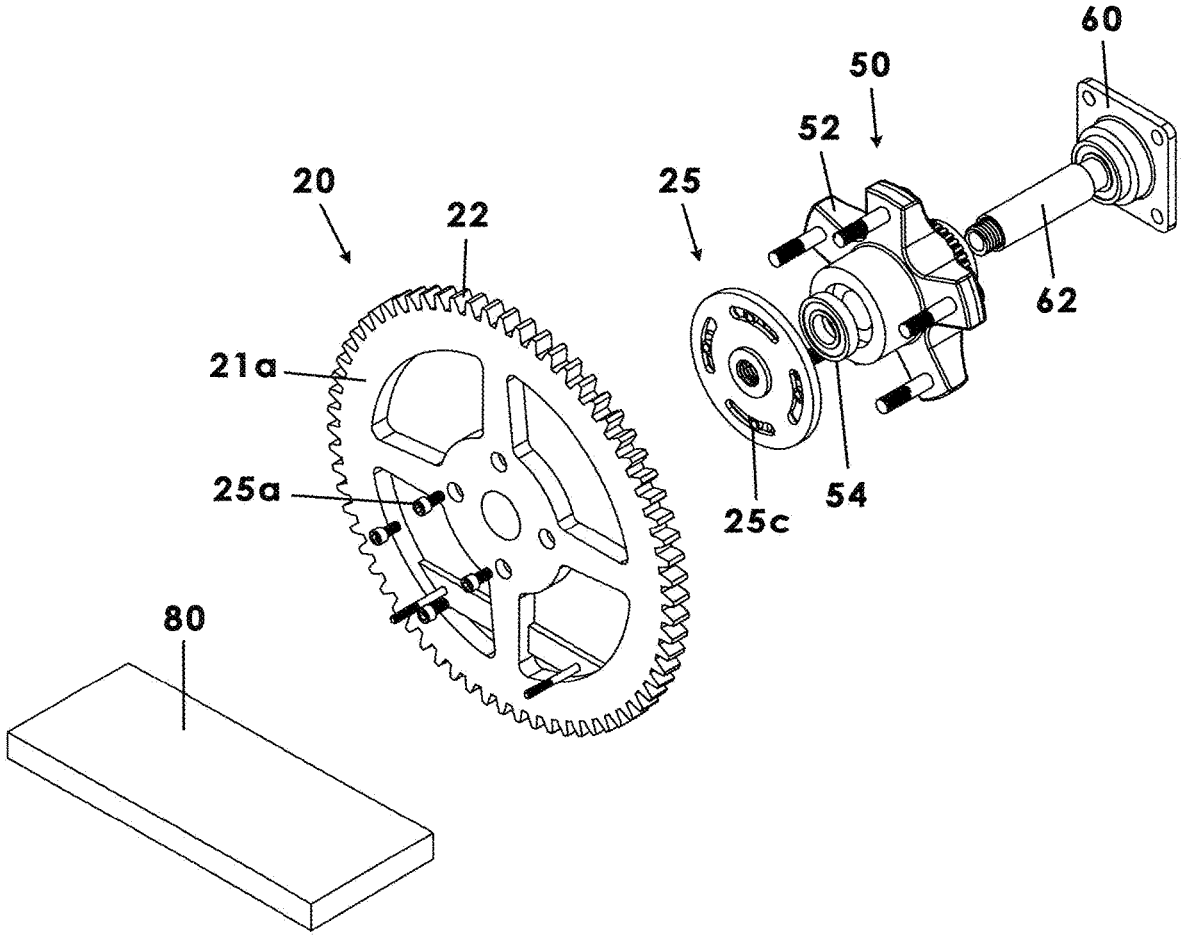
FIG. 6 is an exploded view of the drive gear illustrated in FIG. 5*b;*
Figure 7A:
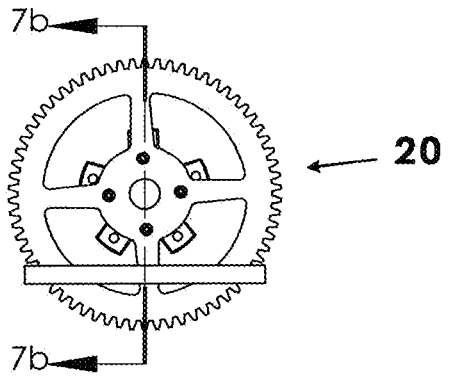
FIG. 7*a* is a front view of the drive gear as in FIG. 6*a;*
Figure 7B:
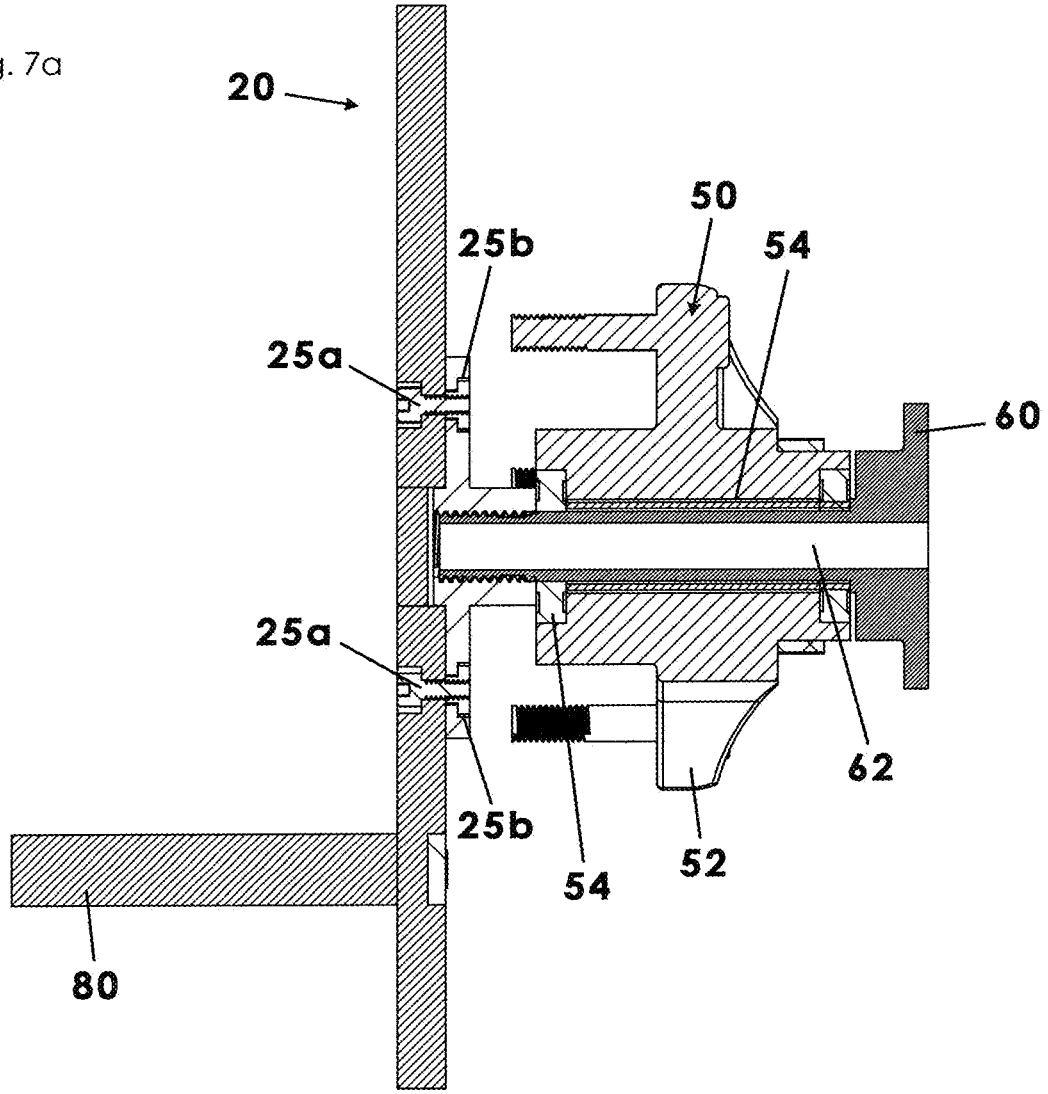
FIG. 7*b* is a sectional view taken along line 7*b*-7*b* of FIG. 7*a;*
Figure 8A:
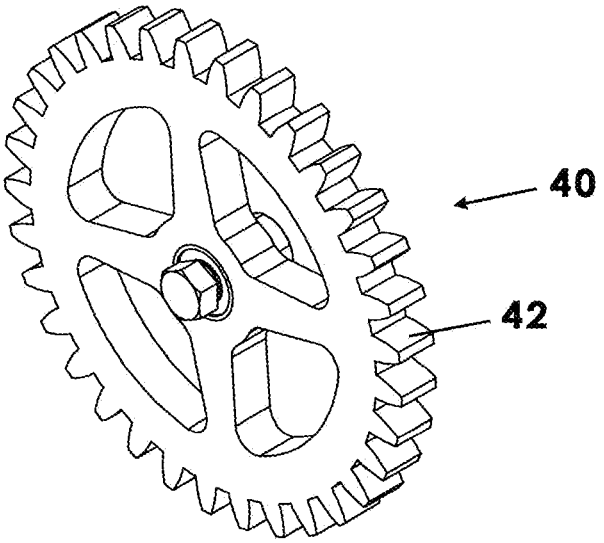
FIG. 8*a* is a perspective view of a planetary gear removed from the multi-wheel assembly as in FIG. 1.
Figure 8B:
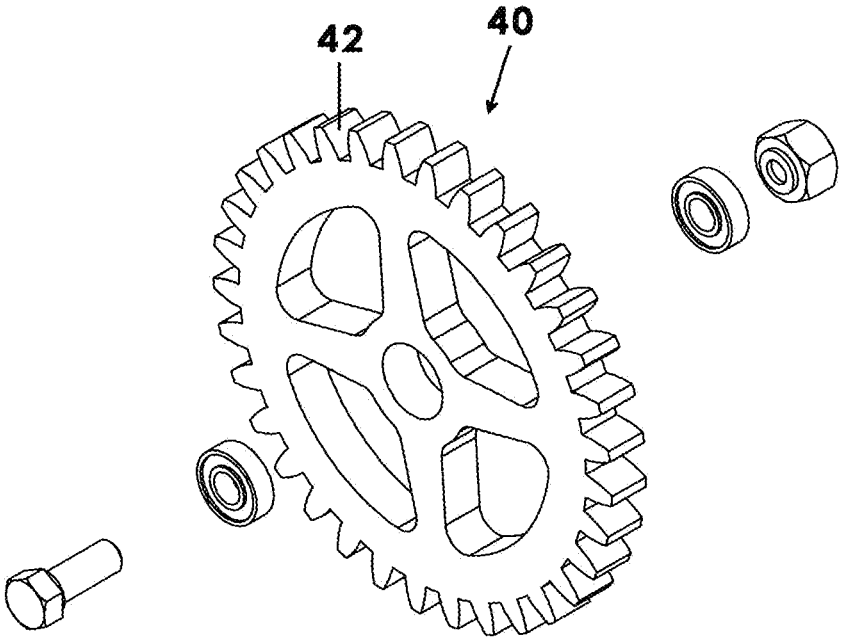
FIG. 8*b* is an exploded view of the planetary gear illustrated in FIG. 9*a;*
Figure 9A:
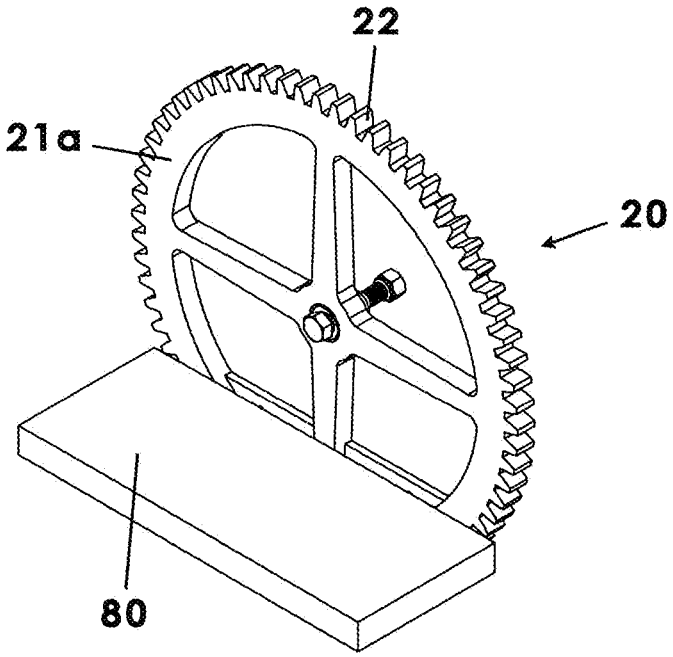
FIG. 9*a* is a perspective view of an orbital gear removed from the multi-wheel assembly as an FIG. 1.
Figure 9B:
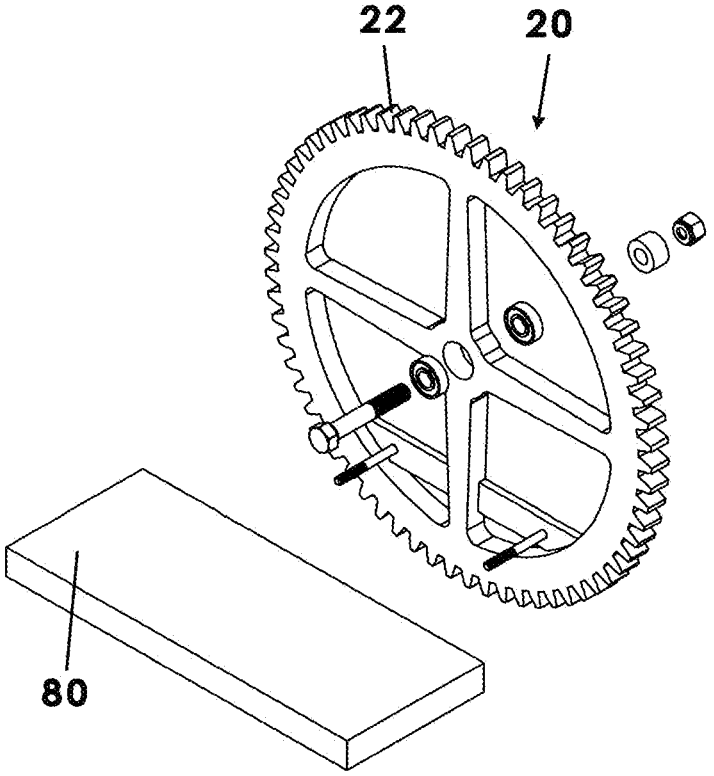
FIG. 9*b* is an exploded view of the orbital gear illustrated in FIG. 9*a*.

Further, the hub 50 includes a plurality of hub arms 52, each arm including a bolt 53 or similar fastener extending forwardly (FIG. 6). In the environment as illustrated, the hub 50 includes hub arms 52 to and, therefore, five bolts. Preferably, all of the bolts are fixedly coupled to the interface plate 11, such as with complementary threaded configurations, nuts, or other complementary fasteners as is illustrated by comparing FIG. 4*b* and then FIG. 4*a*. This fixed and complementary attachment can be seen in FIGS. 1 and 2 as well. It can be seen, therefore, that the hub 50 is rotatably movable, the hub is fixedly coupled to the interface plate 11 which is also rotatable, and the interface plate is fixedly coupled to the peripheral frame member 12 which is also rotatable. Accordingly, the hub 50, interface plate 11, peripheral frame member 12, and any other wheels (a.k.a. gears) and that are coupled to the peripheral frame member 12 are rotated in unison as will be further described below. In use, the configuration of the hub 50 enables the peripheral frame member 12 to rotate or "orbit" whilst the drive wheel 20 remains fixed and unable to rotate.

More particularly, the multi-wheel rotational shelving assembly 10 includes a pair of gear assemblies that are configured to move rotationally about the fixed drive wheel 20 so as to move a selected shelf into a lower or more accessible position. More particularly, the multi-wheel rotational shelving assembly 10 includes a drive wheel 20 surrounded by a planetary wheel assembly 40 which is surrounded by an orbiting wheel assembly 30. It is understood that each "wheel" referenced below is, in the preferred embodiment, a "gear" having teeth and being pivotally mounted so as to be rotatable unless specifically described otherwise.

Described in even more detail, the multi-wheel rotational shelving assembly 10 includes a drive wheel 20 having the configuration of a circular plate that may be attached to a forward end of the shaft 62 (FIG. 6). It is understood that the drive wheel 20 may include an axial aperture or slot configured to receive the shaft 62 that extends longitudinally from the mounting plate 60. Again, the drive wheel 20 has a generally fixed position and is not rotatable other than for initial calibration or leveling as will be described later. Specifically, the drive wheel 20 may be threadably attached to the shaft 62 in a friction fit engagement (FIG. 7*b*) and may also be attached to a faceplate 25 via a plurality of slot nuts 25*b*, as will be described in greater detail later. The drive wheel 20 includes a peripheral edge having a predetermined number of teeth 22 and defining a first diameter.

In an embodiment, the teeth associated with the drive wheel 20 have a predetermined size and spacing. In use, the drive wheel 20 is positioned in an upright and vertical configuration, i.e., the drive wheel 20 extends upwardly on its peripheral edge of teeth and has a frontside edge 21*a* and a backside edge 21*b*. Geometrically, the drive wheel 20 is mounted axially on the center point of the circle/ring defined by the peripheral frame member 12.

Further, the multi-wheel rotational shelving assembly 10 includes an orbiting wheel assembly having a plurality of orbiting wheels 30 arranged in a circular array, each orbiting wheel being displaced an identical distance away from the peripheral edge of drive wheel 20 and each orbiting wheel being displaced an equal distance away from a next adjacent orbiting wheel 30. Further, each orbiting wheel 30 has a continuous peripheral edge defining a circular plate-like configuration having a second predetermined number of teeth 42 and defining a second diameter. Preferably, each orbiting wheel 30 is positioned in an upright and vertical configuration, i.e., each orbiting wheel 30 extends upwardly on its peripheral edge of teeth and has a frontside edge 31*a* and a backside edge 31*b*. In a critical aspect, the second predetermined number of teeth is equal to the first predetermined number of teeth 32 and the second diameter is equal to the first diameter. As will be discussed below in greater detail, this equality of teeth is critical to maintaining the shelves in a perpetually level orientation as the orbiting wheels 30 revolve around (i.e., orbit) the drive wheel 20.

Each orbiting wheel 30 includes an axle that is pivotally coupled to the peripheral frame member 12 so that the orbiting wheel 30 is free to revolve about the axis defined by the axle. Further, attachment of the orbiting wheel 32 to the peripheral frame member 12 causes the orbiting wheel 30 and its shelf 70 to orbit about the drive wheel 20. Geometrically, the plurality of orbiting wheels 30 are positioned as an array along the outer circumference defined by the peripheral frame member 12.

In addition, the multi-wheel rotational shelving assembly 10 includes a planetary wheel assembly having a plurality of planetary wheels 40. Again, each planetary wheel 40 has a circular and plate-like configuration and a peripheral edge having a plurality of teeth 42. Each planetary wheel 40 defines third diameter. Importantly, the number and configuration of teeth and diameter of each planetary wheel can be—but is not required to be—equal to the number of teeth and diameters of the drive wheel and orbiting wheels. Each planetary wheel 40 is pivotally coupled to a respective spoke 13 of the framework. Geometrically, the plurality of planetary wheels 40 are arranged as an array about a line that defines an intermediate circumference of the circle defined by the peripheral frame member 12. In use, the plurality of planetary wheels is positioned intermediate the plurality of orbiting wheels 30 and the drive wheel 20. More particularly, the teeth 42 of each planetary wheel 40 is operatively and simultaneously engaged, on one side, with the teeth 32 of corresponding orbiting wheels 30 and, on another side, with the teeth 22 of the drive wheel 20.

In the primary and most critical aspect of the invention, the multi-wheel rotational shelving assembly 10 includes a plurality of shelves 70 coupled to the plurality of orbiting wheels 30, respectively, and to the drive wheel 20. More particularly, each shelf 70 is fixedly attached to a frontside edge 31*a* of an orbiting wheel 30, respectively. Further, each shelf 70 has a flat or planar configuration that is level or parallel with a floor surface. In other words, each shelf 70 defines a horizontal plane that is generally perpendicular to a vertical plane defined by the frontside edge 31*a*. As has been explained in detail above, the plurality of shelves 70 remain level throughout operation and engagement of the wheels described above.

Similarly, an auxiliary shelf 80 is coupled to the front side edge 21*a* of the drive wheel 20 and extends forwardly therefrom. The auxiliary shelf 80 has a flat or planar configuration that is level or parallel with a floor surface. Obviously, the auxiliary shelf 80 maintains its level orientation in that the drive wheel 22 to which it is attached does not rotate except as will be described specifically below.

Attachment of the driveshaft to the faceplate 25 introduced above may be with a plurality of fasteners such as shaft bolts 25*a*. The faceplate 25, therefore, may be tightened and fixed unless and until the shaft bolts 25*a* are loosened and a calibration process as explained below. In this critical aspect, the drive wheel 20 may be loosened from being fixedly attached to the faceplate 25 and shaft 62 and, in its loosened state, the drive wheel 20 may be gently rotated so as to calibrate the auxiliary shelf 80 into its preferred level configuration. This calibration or rotation is possible because of the unique configuration of the faceplate 11. More particularly, the faceplate 25 defines a plurality of slots 25*c*, each slot having an arched configuration, the faceplate 25 including a plurality of fasteners 25*a* and slot nuts 25*b* positioned in respective slots 25*c*. Accordingly, the bolts by which the drive wheel 20 is tightly fastened to the faceplate 25 may be loosened such that slot nuts 25*b* may be moved along corresponding slots 25*c*, the rotational movement that involves slightly rotating the drive wheel 20 itself so as to level up the auxiliary shelf 80. Thereafter, the bolts may be tightened down such that the drive wheel 20 is once again fixedly attached to the hub and not rotatable.

Figure 2:
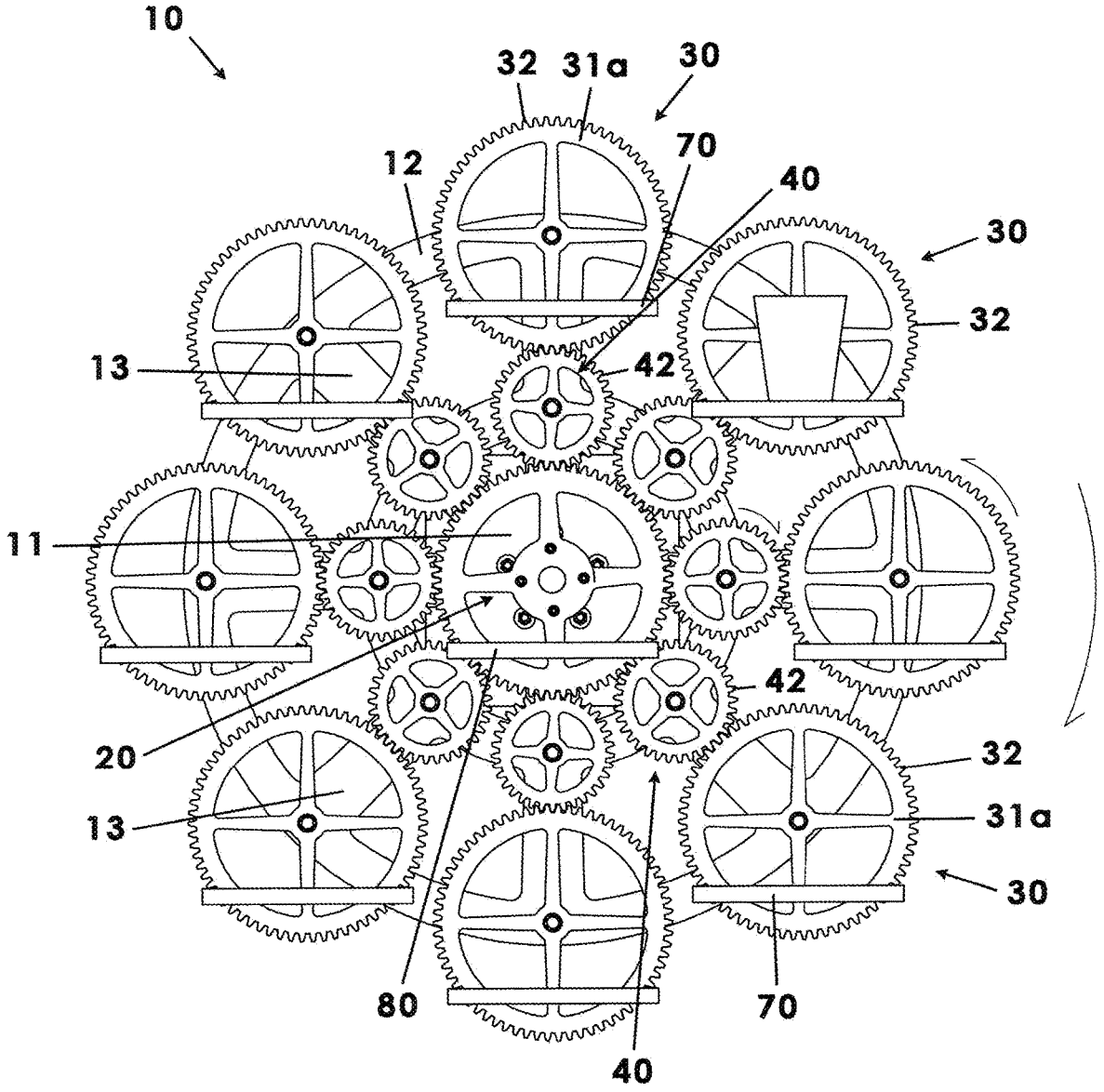
FIG. 2 is a front view of the multi-wheel rotational shelving assembly as in FIG. 1, illustrated with the shelves in a first position.
Figure 3:
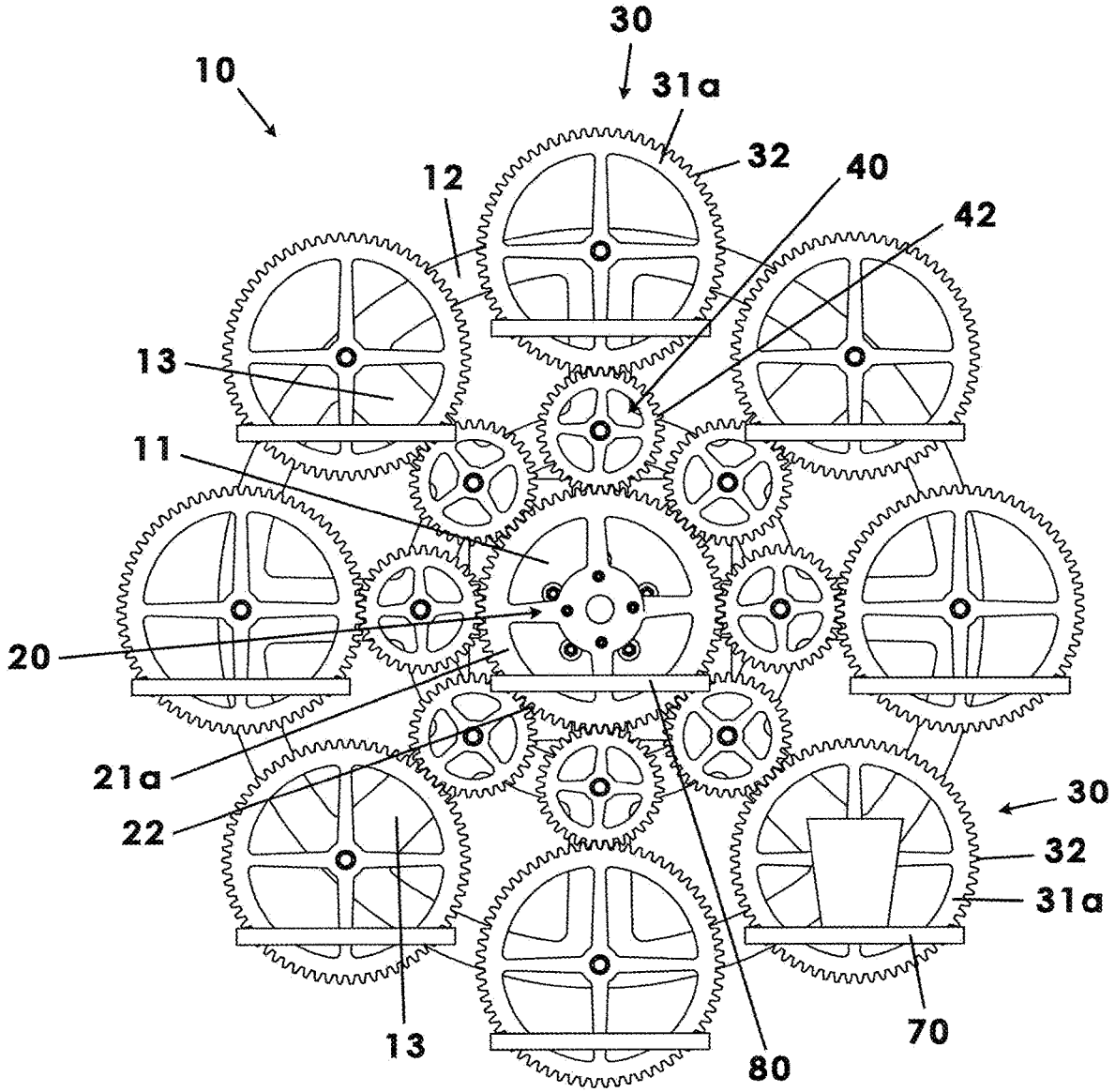
FIG. 3 is another front view of the multi-wheel rotational shelving assembly as in FIG. 2, illustrated with the shelves rotated to a second position.
Figure 4A:
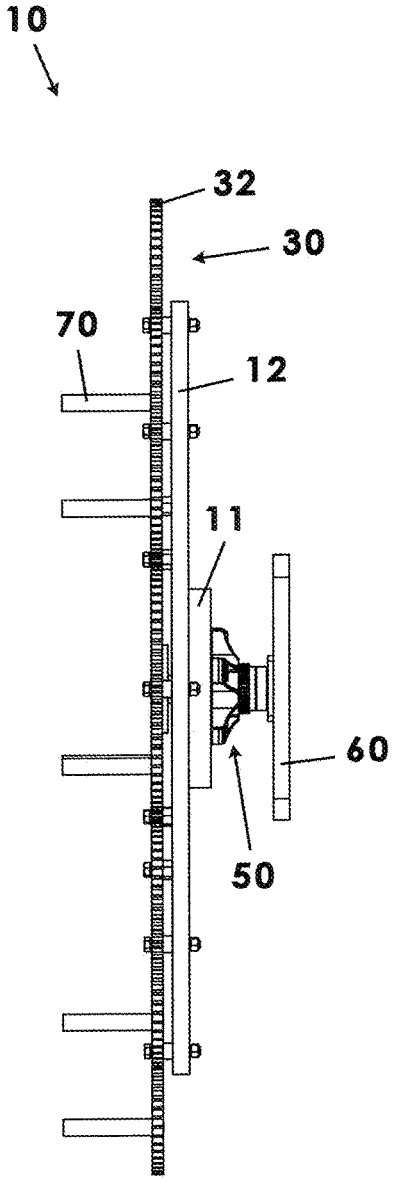
FIG. 4*a* is a side view of the multi-wheel rotational shelving assembly as in FIG. 1.
Figure 4B:
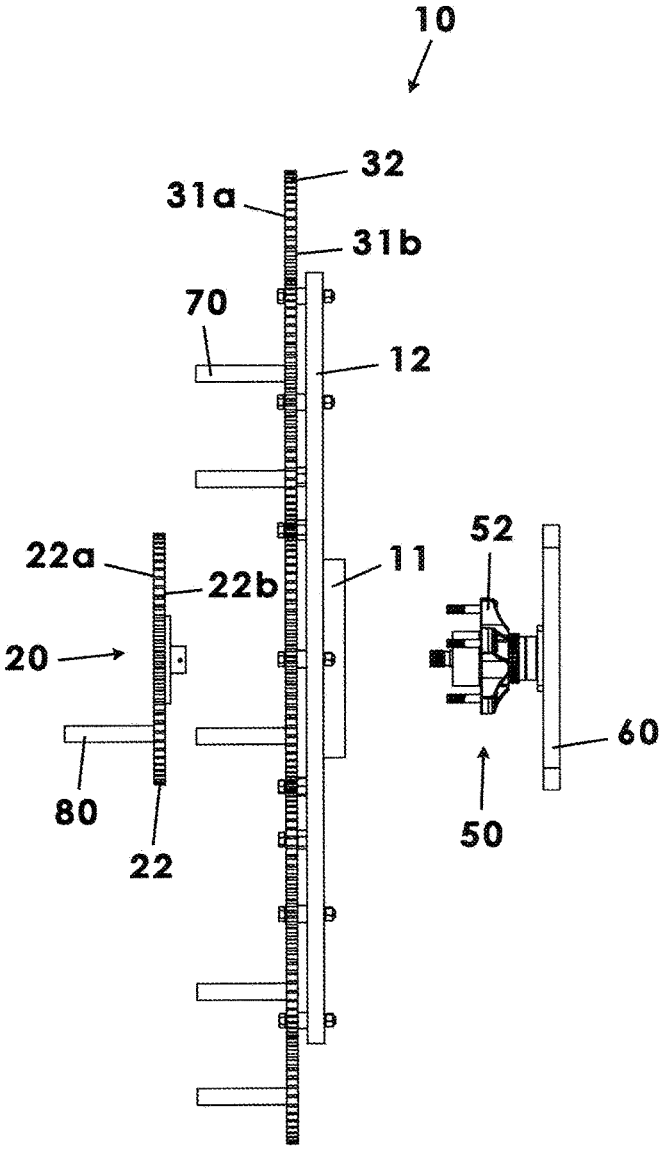
FIG. 4*b* is an exploded view of the multi-wheel rotational shelving assembly as in FIG. 4*a;*

In use, the user may manually grasp and rotate the peripheral frame member 12 which causes rotation of itself and the array of orbiting wheels 30 as seen by comparing movement of the face shown in FIGS. 2 and 3. Further, this clockwise rotation causes the plurality of planetary wheels 40 to also move in a rotational orbit about the drive wheel 20 which causes a counterclockwise movement of the plurality of orbiting wheels 30, respectively. Respective shelves 70, however, are maintained in a level configuration because the predetermined number of teeth 22 about the drive wheel 20 are the same as the predetermined number of teeth 32 of the plurality of orbiting wheels 30, respectively. The direction of rotation of respective wheels are indicated with arrows in FIG. 2. The direction of rotation, of course, may be reversed.

Figure 5C:
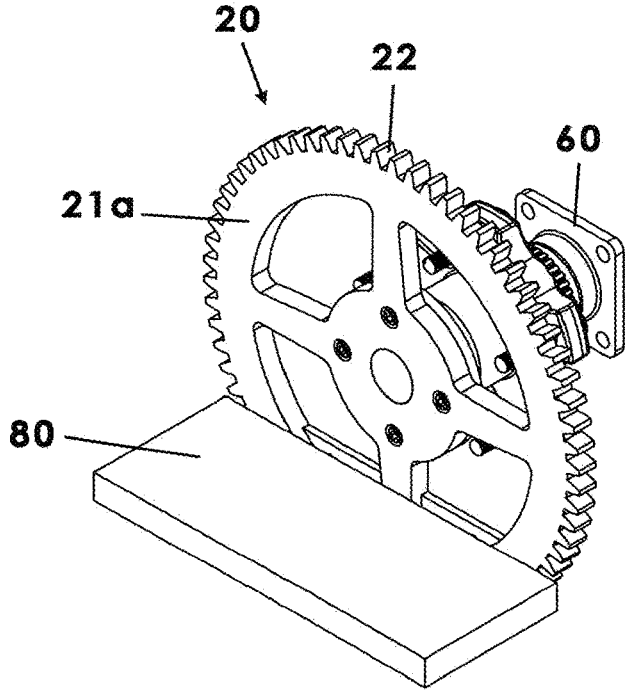
FIG. 5*c* is a front perspective view of the drive wheel as illustrated in FIG. 5*a;*
Figure 5B:
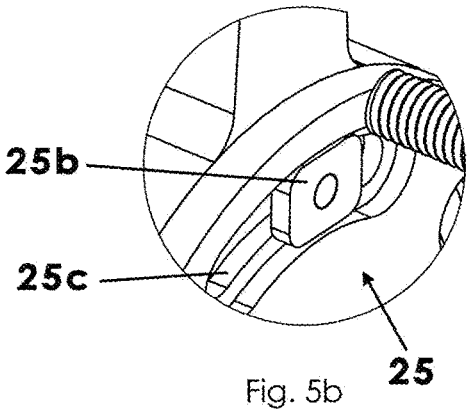
FIG. 5*b* is an isolated view on an enlarged scale taken from FIG. 5*a;*

In one more aspect, rotation of the peripheral frame member 12 may be actuated via operation of a motor 90 and belt combination as shown in FIGS. 5 and 6. More particularly, the motor and belt combination may be mounted forwardly proximate the mounting plate 60 and the belt is coupled to the hub 50. Therefore, when the motor is actuated, such as by operation of an on/off button or other activation of a battery or connection to AC electricity, the belt will operate the hub to rotate which, as described above, rotates the peripheral frame member and all gear wheels attached thereto.

It is understood that while certain forms of this invention have been illustrated and described, it is not limited thereto except insofar as such limitations are included in the following claims and allowable functional equivalents thereof.

The invention claimed is:

1. A multi-wheel rotational shelving assembly, comprising:

a drive wheel configured for fixed attachment to a wall structure so as to be unrotatable, said drive wheel including a peripheral edge having a first predetermined number of teeth, said drive wheel having a circular configuration defining a first diameter;

an orbiting wheel assembly having a plurality of orbiting wheels each being displaced from an adjacent orbiting wheel and being displaced a predetermined distance from said peripheral edge of said drive wheel, said plurality of orbiting wheels each including a peripheral edge having a second predetermined number of teeth and having a circular configuration defining a second diameter;

wherein said second predetermined number of teeth is equal to said first predetermined number of teeth;

a planetary wheel assembly having a plurality of planetary wheels each being displaced from an adjacent planetary wheel and being situated intermediate a corresponding orbiting wheel and said drive wheel, said plurality of planetary wheels each including a peripheral edge having a third predetermined number of teeth and having a circular configuration defining a third diameter;

wherein respective teeth of said each planetary wheel are operatively and simultaneously engaged with a respective one of said teeth of said drive wheel and with a respective one of said teeth of a respective orbiting wheel;

a plurality of shelves, each shelf being coupled to a frontside edge of each said respective orbiting wheel and extending away therefrom, each said shelf having an upper surface that is planar and parallel to a floor surface.

2. The shelving assembly as in claim 1, further comprising an auxiliary shelf coupled to a frontside edge of said drive wheel and extending away therefrom, said auxiliary shelf having an upper surface that is planar and parallel to the floor surface.

3. The shelving assembly as in claim 1, further comprising:

a framework having an interface plate, a peripheral frame member concentrically displaced from the interface plate, and a plurality of spokes extending between said interface plate and said peripheral frame member, said peripheral frame member having a circular configuration that is radially displaced from the interface plate; and a hub coupled to the interface plate so as to rotate when said peripheral frame member rotates.

4. The shelving assembly as in claim 3, wherein each said orbiting wheel is pivotally coupled to said peripheral frame member such that a rotational movement of said peripheral frame member causes a complementary rotational movement of said plurality of orbiting wheels, respectively.

5. The shelving assembly as in claim 4, wherein each said planetary wheel is pivotally coupled to a respective one of said spokes of the framework such that the rotational movement of said peripheral frame member causes another complementary rotational movement of said plurality of planetary wheels, respectively.

6. The shelving assembly as in claim 3, wherein:

said peripheral frame member defines an outer circumference, said plurality of orbiting wheels being arranged radially along said outer circumference;

the framework geometrically defines a center point that is an equal distance from every point on the outer circumference of the peripheral frame member, said faceplate being positioned about said center point;

said framework geometrically defines an intermediate circumference between said peripheral frame member and said center point, said plurality of planetary wheels being arranged radially along said intermediate circumference.

7. The shelving assembly as in claim 3, wherein said drive wheel is fixed in space and does not rotate with respect to the framework.

8. The shelving assembly as in claim 5, further comprising a mounting plate configured for fixed attachment to a wall structure, said mounting plate including a shaft extending forwardly through a central bore defined by said hub and said drive wheel.

9. The shelving assembly as in claim 8, further comprising:

a faceplate coupled to said drive wheel with a plurality of fasteners and defining a plurality of slots spaced apart radially, said faceplate including a plurality of slot nuts positioned in said slots each configured to receive said plurality of fasteners, respectively; and said plurality of slots are each configured to enable said drive wheel (1) to rotate radially when said plurality of fasteners are loosened from respective slot nuts and (2) to prevent said drive wheel from rotating radially when said plurality of fasteners are tightened.

10. The shelving assembly as in claim 3, further comprising a drive motor and belt combination operatively coupled to said hub so as to actuate said peripheral frame member to rotate when said drive motor is energized.

11. A multi-wheel rotational shelving assembly, comprising:

a framework that includes an interface plate and a peripheral frame member having a circular configuration that is radially displaced from the interface plate, said framework including a plurality of spokes extending between said interface plate and said peripheral frame member;

a hub operatively connected to said peripheral frame member such that said peripheral frame member is selectively rotationally movable, said hub defining a central bore;

a shaft extending through said central bore and attached to said hub via bearings, said shaft being fixed and unrotatable;

a drive wheel fixedly coupled to said shaft, said drive wheel including a peripheral edge having a first predetermined number of teeth, said drive wheel having a circular configuration defining a first diameter;

an orbiting wheel assembly having a plurality of orbiting wheels each being displaced from an adjacent orbiting wheel and being displaced a predetermined distance from said peripheral edge of said drive wheel, said plurality of orbiting wheels each including a peripheral edge having (1) a second predetermined number of teeth that is equal to said first predetermined number of teeth and having (2) a circular configuration defining a second diameter that is equal to that first diameter;

wherein said each orbiting wheel includes an axle that is pivotally coupled to said peripheral frame member of said framework that defines an imaginary orbiting wheel axis about which to rotate and such that a rotational movement of said peripheral frame member causes a corresponding rotational movement of said plurality of orbiting wheels;

a planetary wheel assembly having a plurality of planetary wheels each being displaced from an adjacent planetary wheel and being situated intermediate a corresponding orbiting wheel and said drive wheel, each planetary wheel being pivotally coupled to a respective one of said spokes of said framework, said plurality of planetary wheels each including a peripheral edge having a third predetermined number of teeth and having a circular configuration defining a third diameter;

wherein respective teeth of said each planetary wheel are operatively and simultaneously engaged with a respective one of said teeth of said drive wheel and with a one of said teeth of a respective orbiting wheel; and a plurality of shelves each shelf being coupled to a frontside edge of each said respective orbiting wheel and extending away therefrom, each said shelf having an upper surface that is planar and parallel to a floor surface.

12. The shelving assembly as in claim 11, wherein:

said peripheral frame member defines an outer circumference, said plurality of orbiting wheels being arranged radially along said outer circumference of the peripheral frame member;

the framework defines a center point that is an equal distance from every point on the peripheral frame member, said interface plate being positioned about said center point;

said framework defines an intermediate circumference between said peripheral frame member and said center point, said plurality of planetary wheels being arranged radially along said intermediate circumference.

13. The shelving assembly as in claim 11, wherein said hub includes a plurality of hub arms each being coupled to the interface plate such that said hub, said interface plate, and said peripheral frame member are unitarily rotatable.

14. The shelving assembly as in claim 11, further comprising:

a faceplate coupled to said drive wheel with a plurality of fasteners and defining a plurality of slots spaced apart radially, said faceplate including a plurality of slot nuts positioned in said slots each configured to receive said plurality of fasteners, respectively; and said plurality of slots are each configured to enable said drive wheel (1) to rotate radially when said plurality of fasteners are loosened from respective slot nuts and (2) to prevent said drive wheel from rotating radially when said plurality of fasteners are tightened.

15. The shelving assembly as in claim 11, further comprising a drive motor and belt combination operatively coupled to the rotatable portion of said hub so as to actuate said peripheral frame member to rotate when said drive motor is energized.

16. The shelving assembly as in claim 11, further comprising an auxiliary shelf coupled to a frontside edge of said drive wheel and extending away therefrom, said auxiliary shelf having an upper surface that is planar and parallel to the floor surface.

17. The shelving assembly as in claim 11, wherein:

said drive wheel is a drive gear;

said plurality of orbiting wheels are each an orbiting gear; and said plurality of planetary wheels are each a planetary gear.

* * * * *